US011475849B1

(12) United States Patent
Qiao et al.

(10) Patent No.: US 11,475,849 B1
(45) Date of Patent: Oct. 18, 2022

(54) DISPLAY DEVICE WITH REDUCED SCANNING TIME BY USING SEPARATE REFERENCE VOLTAGE LINE

(71) Applicant: META PLATFORMS TECHNOLOGIES, LLC, Menlo Park, CA (US)

(72) Inventors: Wenhao Qiao, Milpitas, CA (US); Cheonhong Kim, Mountain View, CA (US); Min Hyuk Choi, San Jose, CA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 0 days.

(21) Appl. No.: 17/319,015

(22) Filed: May 12, 2021

(51) Int. Cl.
*G09G 5/00* (2006.01)
*G09G 3/3291* (2016.01)

(52) U.S. Cl.
CPC ... *G09G 3/3291* (2013.01); *G09G 2300/0439* (2013.01); *G09G 2310/0272* (2013.01)

(58) Field of Classification Search
CPC ..... G09G 3/3291; G09G 2300/0439; G09G 2310/0272; G09G 2310/0251; G09G 2310/061; G09G 2310/062; G09G 2310/0252; G09G 2310/0266; G09G 2310/0248
See application file for complete search history.

(56) References Cited

U.S. PATENT DOCUMENTS

2013/0140537 A1 6/2013 Ha et al.
2015/0138253 A1 5/2015 Kimura et al.
2017/0287390 A1* 10/2017 Lee ..... G09G 3/3233
2018/0053462 A1 2/2018 Bae et al.
2019/0051247 A1 2/2019 Chang et al.
2021/0312864 A1 10/2021 Zheng

FOREIGN PATENT DOCUMENTS

CN 111223447 A 6/2020
KR 102124110 B1 * 6/2020 ..... G09G 5/001

OTHER PUBLICATIONS

International Search Report and Written Opinion for International Application No. PCT/US2022/028394, dated Jul. 7, 2022, 12 pages.

* cited by examiner

*Primary Examiner* — Adam R. Giesy
(74) *Attorney, Agent, or Firm* — Fenwick & West LLP

(57) ABSTRACT

Embodiments relate to a display device with reduced scanning time by using a reference line separate from a data line to improve frame rate of the display device. A first pixel in a first row samples a reference voltage during a first period and samples a data voltage during a second period. A second pixel in a second row adjacent to the first row samples the reference voltage during a third period and samples the data voltage during a fourth period, where the third period overlaps with at least a portion of the second period. The reference voltage is provided by the reference line that is connected to a reference buffer, and the data voltage is provided by the data line connected to a source driver circuit.

18 Claims, 14 Drawing Sheets

DISPLAY DEVICE WITH REDUCED SCANNING TIME BY USING SEPARATE REFERENCE VOLTAGE LINE

BACKGROUND

This disclosure relates to a display device, and specifically to operating the display device using a time sharing scheme between rows of pixels.

A display device is often used in a virtual reality (VR) or augmented-reality (AR) system as a head-mounted display (HMD) or a near-eye display (NED). The display device may include an array of OLED pixels that emits light. To display a high-resolution image, the display device may include a large number of pixels in the array that are operated at a high frame rate. Conventionally, during a display frame, a first row of pixels sample reference voltages during a first period used to compensate for variation in threshold voltage in the driving transistor of the pixels and sample data voltage during a second period used to display an image after the end of the first period. After the first row of pixels have completed sampling the reference voltages and data voltages, a second row of pixels adjacent to the first row of pixels sample reference voltages during a third period after the end of the second period. To improve the frame rate of the display device, the duration of the periods for sampling reference voltages and sampling data voltages may be shortened. However, this may lead to nonuniform images due to settling error caused by lack of sufficient settling time for the pixels.

SUMMARY

Embodiments relate to a display device including a display driver circuit that generates data voltages and a reference voltage and a display panel that displays images based on the data voltages and the reference voltage. The display panel is coupled to the display driver circuit and includes subpixels arranged into rows and columns, where each subpixel emits light according to a difference between sampled data voltages and sampled reference voltages. A first row of the subpixels samples the reference voltage during a first period and samples the data voltages during a second period subsequent to the first period. A second row of the subpixels adjacent to the first row of subpixels samples the reference voltage during a third period that overlaps with at least a portion of the second period.

The figures depict embodiments of the present disclosure for purposes of illustration only.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, the described embodiments may be practiced without these specific details. In other instances, well-known methods, procedures, components, circuits, and networks have not been described in detail so as not to unnecessarily obscure aspects of the embodiments.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

Figure 1:
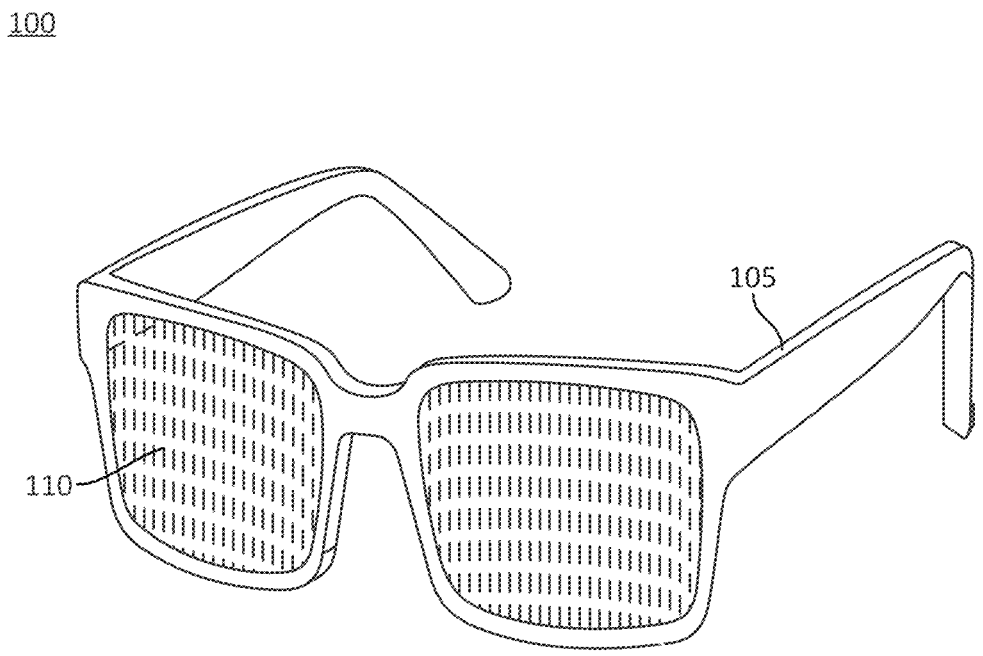
FIG. 1 is a diagram of a head-mounted display (HMD) that includes a near-eye display (NED), according to some embodiments.

FIG. 1 is a diagram of a near-eye-display (NED) 100, in accordance with some embodiments. The NED 100 may present media to a user. Examples of media that may be presented by the NED 100 include one or more images, video, audio, or some combination thereof. In some embodiments, audio may be presented via an external device (e.g., speakers and/or headphones) that receives audio information from the NED 100, a console (not shown), or both, and presents audio data to the user based on the audio information. The NED 100 is generally configured to operate as a virtual reality (VR) NED. However, in some embodiments, the NED 100 may be modified to also operate as an augmented reality (AR) NED, a mixed reality (MR) NED, or some combination thereof. For example, in some embodiments, the NED 100 may augment views of a physical, real-world environment with computer-generated elements (e.g., still images, video, sound, etc.).

The NED 100 shown in FIG. 1 may include a frame 105 and a display 110. The frame 105 may include one or more optical elements that together display media to a user. That is, the display 110 may be configured for a user to view the content presented by the NED 100. As discussed below in conjunction with FIG. 2, the display 110 may include at least one source assembly to generate image light to present optical media to an eye of the user. The source assembly may include, e.g., a source, an optics system, or some combination thereof.

FIG. 1 is merely an example of a virtual reality system, and the display systems described herein may be incorporated into further such systems. In some embodiments, FIG. 1 may also be referred to as a Head-Mounted-Display (HMD).

Figure 2:
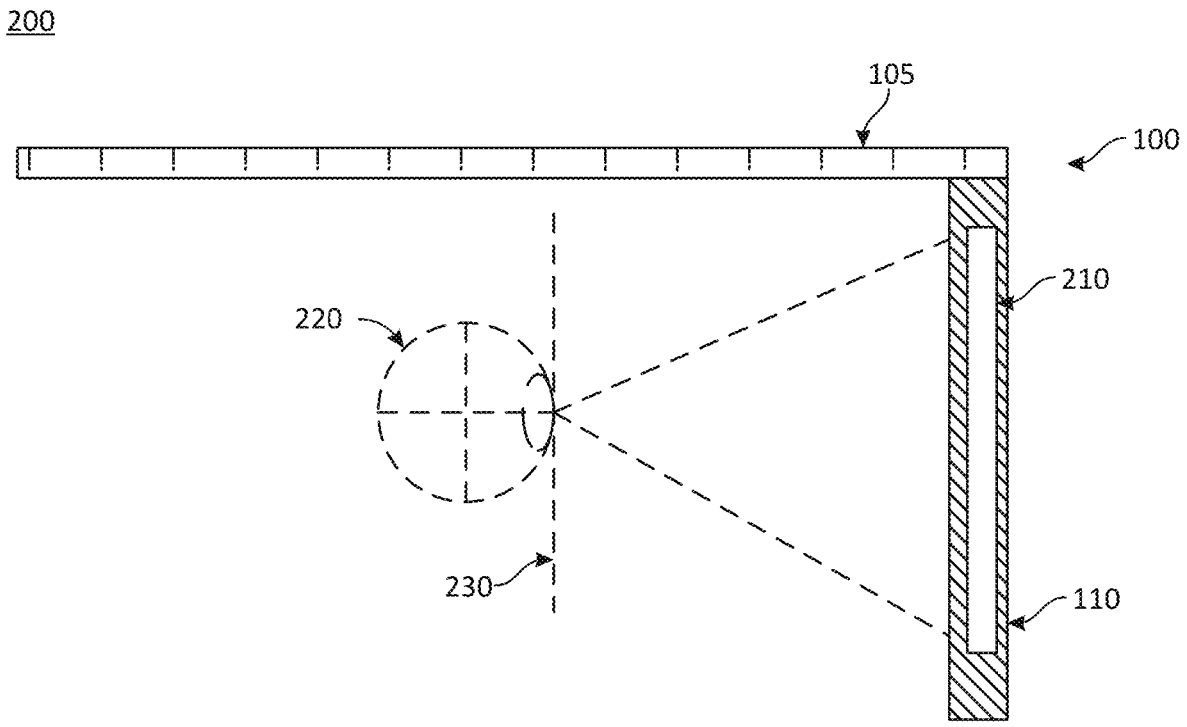
FIG. 2 is a cross-sectional view of the HMD illustrated in FIG. 1, according to some embodiments.

FIG. 2 is a cross section 200 of the NED 100 illustrated in FIG. 1, in accordance with some embodiments of the present disclosure. The cross section 200 may include at least one display assembly 210, and an exit pupil 230. The exit pupil 230 is a location where the eye 220 may be positioned when the user wears the NED 100. In some embodiments, the frame 105 may represent a frame of eye-wear glasses. For purposes of illustration, FIG. 2 shows the cross section 200 associated with a single eye 220 and a single display assembly 210, but in alternative embodiments not shown, another display assembly that is separate from or integrated with the display assembly 210 shown in FIG. 2, may provide image light to another eye of the user.

The display assembly 210 may direct the image light to the eye 220 through the exit pupil 230. The display assembly 210 may be composed of one or more materials (e.g., plastic, glass, etc.) with one or more refractive indices that effectively decrease the weight and widen a field of view of the NED 100.

In alternate configurations, the NED 100 may include one or more optical elements (not shown) between the display assembly 210 and the eye 220. The optical elements may act to, by way of various examples, correct aberrations in image light emitted from the display assembly 210, magnify image light emitted from the display assembly 210, perform some other optical adjustment of image light emitted from the display assembly 210, or combinations thereof. Example optical elements may include an aperture, a Fresnel lens, a convex lens, a concave lens, a filter, or any other suitable optical element that may affect image light.

In some embodiments, the display assembly 210 may include a source assembly to generate image light to present media to a user's eyes. The source assembly may include, e.g., a light source, an optics system, or some combination thereof. In accordance with various embodiments, a source assembly may include a light-emitting diode (LED) such as an organic light-emitting diode (OLED).

Figure 3:
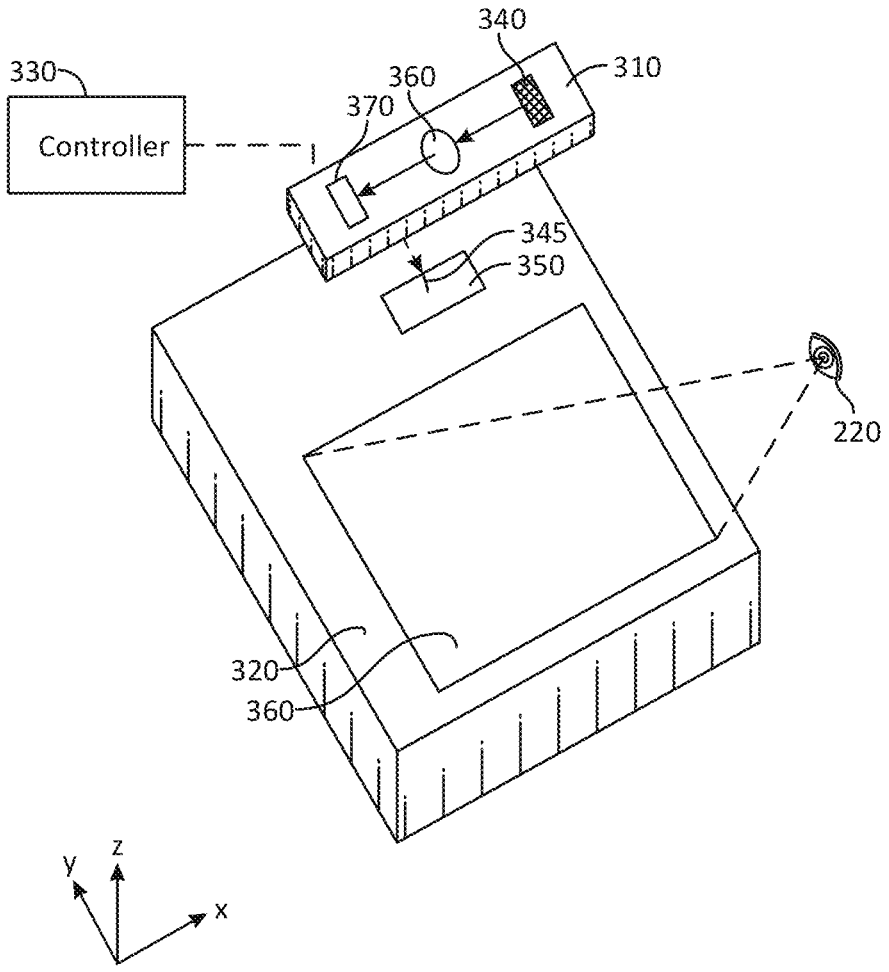
FIG. 3 illustrates a perspective view of a waveguide display, according to some embodiments.

FIG. 3 illustrates a perspective view of a waveguide display 300 in accordance with some embodiments. The waveguide display 300 may be a component (e.g., display assembly 210) of NED 100. In alternate embodiments, the waveguide display 300 may constitute a part of some other NED, or other system that directs display image light to a particular location.

The waveguide display 300 may include, among other components, a source assembly 310, an output waveguide 320, and a controller 330. For purposes of illustration, FIG. 3 shows the waveguide display 300 associated with a single eye 220, but in some embodiments, another waveguide display separate (or partially separate) from the waveguide display 300 may provide image light to another eye of the user. In a partially separate system, for instance, one or more components may be shared between waveguide displays for each eye.

The source assembly 310 generates image light. The source assembly 310 may include a source 340, a light conditioning assembly 360, and a scanning mirror assembly 370. The source assembly 310 may generate and output image light 345 to a coupling element 350 of the output waveguide 320.

The source 340 may include a source of light that generates at least a coherent or partially coherent image light 345. The source 340 may emit light in accordance with one or more illumination parameters received from the controller 330. The source 340 may include one or more source elements, including, but not restricted to light emitting diodes, such as micro-OLEDs, as described in detail below with reference to FIGS. 4-10.

The output waveguide 320 may be configured as an optical waveguide that outputs image light to an eye 220 of a user. The output waveguide 320 receives the image light 345 through one or more coupling elements 350 and guides the received input image light 345 to one or more decoupling elements 360. In some embodiments, the coupling element 350 couples the image light 345 from the source assembly 310 into the output waveguide 320. The coupling element 350 may be or include a diffraction grating, a holographic grating, some other element that couples the image light 345 into the output waveguide 320, or some combination thereof. For example, in embodiments where the coupling element 350 is a diffraction grating, the pitch of the diffraction grating may be chosen such that total internal reflection occurs, and the image light 345 propagates internally toward the decoupling element 360. For example, the pitch of the diffraction grating may be in the range of approximately 300 nm to approximately 600 nm.

The decoupling element 360 decouples the total internally reflected image light from the output waveguide 320. The decoupling element 360 may be or include a diffraction grating, a holographic grating, some other element that decouples image light out of the output waveguide 320, or some combination thereof. For example, in embodiments where the decoupling element 360 is a diffraction grating, the pitch of the diffraction grating may be chosen to cause incident image light to exit the output waveguide 320. An orientation and position of the image light exiting from the output waveguide 320 may be controlled by changing an orientation and position of the image light 345 entering the coupling element 350.

The output waveguide 320 may be composed of one or more materials that facilitate total internal reflection of the image light 345. The output waveguide 320 may be composed of, for example, silicon, glass, or a polymer, or some combination thereof. The output waveguide 320 may have a relatively small form factor such as for use in a head-mounted display. For example, the output waveguide 320 may be approximately 30 mm wide along an x-dimension, 50 mm long along a y-dimension, and 0.5-1 mm thick along a z-dimension. In some embodiments, the output waveguide 320 may be a planar (2D) optical waveguide.

The controller 330 may be used to control the scanning operations of the source assembly 310. In certain embodiments, the controller 330 may determine scanning instructions for the source assembly 310 based at least on one or more display instructions. Display instructions may include instructions to render one or more images. In some embodiments, display instructions may include an image file (e.g., bitmap). The display instructions may be received from, e.g., a console of a virtual reality system (not shown). Scanning instructions may include instructions used by the source assembly 310 to generate image light 345. The scanning instructions may include, e.g., a type of a source of image light (e.g. monochromatic, polychromatic), a scanning rate, an orientation of scanning mirror assembly 370, and/or one or more illumination parameters, etc. The controller 330 may include a combination of hardware, software, and/or firmware not shown here so as not to obscure other aspects of the disclosure.

According to some embodiments, source 340 may include a light emitting diode (LED), such as an organic light emitting diode (OLED). An organic light-emitting diode (OLED) is a light-emitting diode (LED) having an emissive electroluminescent layer that may include a thin film of an organic compound that emits light in response to an electric current. The organic layer is typically situated between a pair of conductive electrodes. One or both of the electrodes may be transparent.

As will be appreciated, an OLED display can be driven with a passive-matrix (PMOLED) or active-matrix (AMOLED) control scheme. In a PMOLED scheme, each row (and line) in the display may be controlled sequentially, whereas AMOLED control typically uses a thin-film transistor backplane to directly access and switch each individual pixel on or off, which allows for higher resolution and larger display areas.

Figure 4:
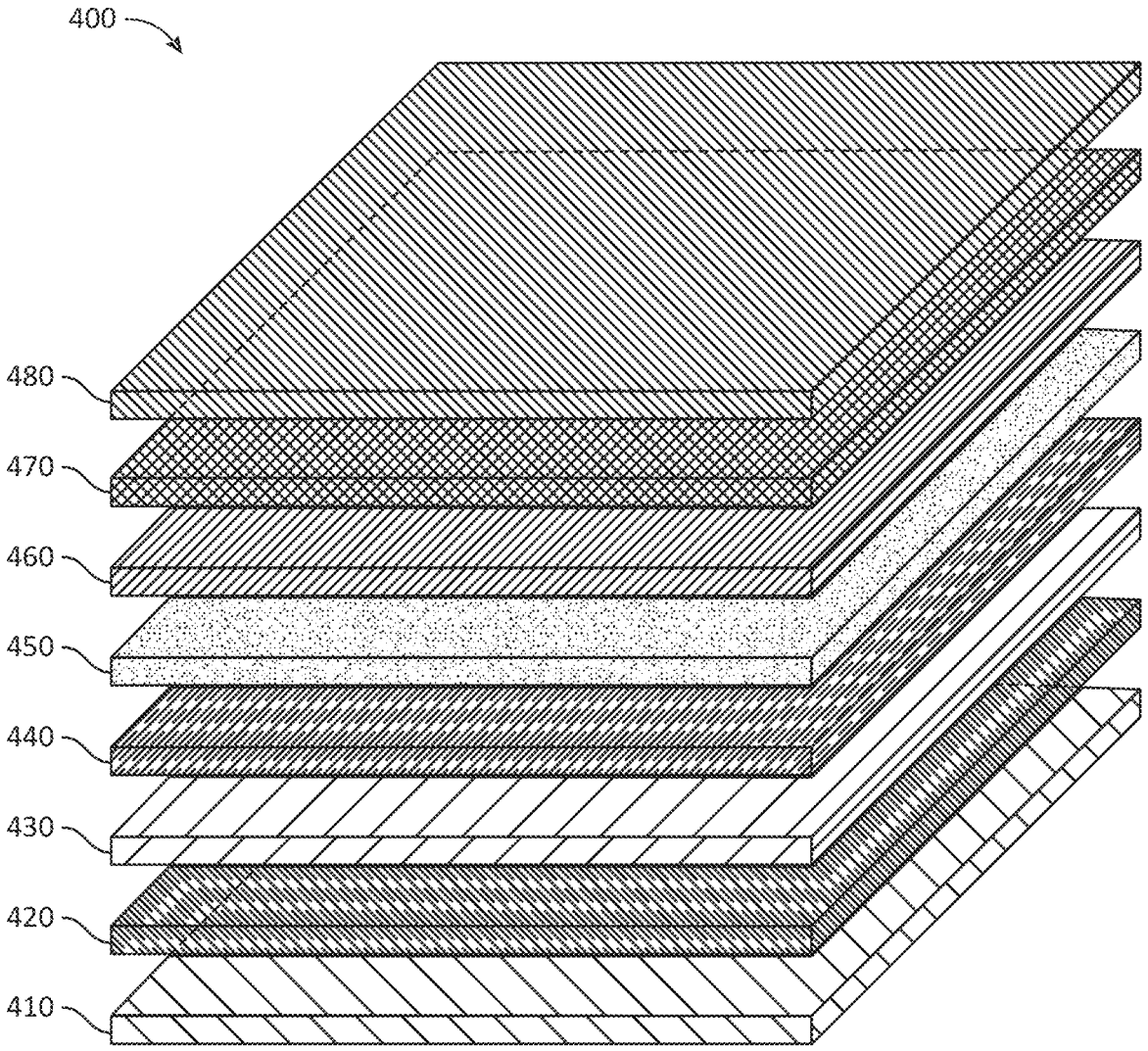
FIG. 4 depicts a simplified organic light-emitting diode (OLED) structure, according to some embodiments.

FIG. 4 depicts a simplified OLED structure according to some embodiments. As shown in an exploded view, OLED 400 may include, from bottom to top, a substrate 410, anode 420, hole injection layer 430, hole transport layer 440, emissive layer 450, blocking layer 460, electron transport layer 470, and cathode 480. In some embodiments, substrate (or backplane) 410 may include single crystal or polycrystalline silicon or other suitable semiconductor (e.g., germanium).

Anode 420 and cathode 480 may include any suitable conductive material(s), such as transparent conductive oxides (TCOs, e.g., indium tin oxide (ITO), zinc oxide (ZnO), and the like). The anode 420 and cathode 480 are configured to inject holes and electrons, respectively, into one or more organic layer(s) within emissive layer 450 during operation of the device.

The hole injection layer 430, which is disposed over the anode 420, receives holes from the anode 420 and is configured to inject the holes deeper into the device, while the adjacent hole transport layer 440 may support the transport of holes to the emissive layer 450. The emissive layer 450 converts electrical energy to light. Emissive layer 450 may include one or more organic molecules, or light-emitting fluorescent dyes or dopants, which may be dispersed in a suitable matrix as known to those skilled in the art.

Blocking layer 460 may improve device function by confining electrons (charge carriers) to the emissive layer 450. Electron transport layer 470 may support the transport of electrons from the cathode 480 to the emissive layer 450.

In some embodiments, the generation of red, green, and blue light (to render full-color images) may include the formation of red, green, and blue OLED sub-pixels in each pixel of the display. Alternatively, the OLED 400 may be adapted to produce white light in each pixel. The white light may be passed through a color filter to produce red, green, and blue sub-pixels.

Any suitable deposition process(es) may be used to form OLED 400. For example, one or more of the layers constituting the OLED may be fabricated using physical vapor deposition (PVD), chemical vapor deposition (CVD), evaporation, spray-coating, spin-coating, atomic layer deposition (ALD), and the like. In further aspects, OLED 400 may be manufactured using a thermal evaporator, a sputtering system, printing, stamping, etc.

According to some embodiments, OLED 400 may be a micro-OLED. A "micro-OLED," in accordance with various examples, may refer to a particular type of OLED having a small active light emitting area (e.g., less than 2,000 μm2 in some embodiments, less than 20 μm2 or less than 10 μm2 in other embodiments). In some embodiments, the emissive surface of the micro-OLED may have a diameter of less than approximately 2 μm. Such a micro-OLED may also have collimated light output, which may increase the brightness level of light emitted from the small active light emitting area.

Figure 5:
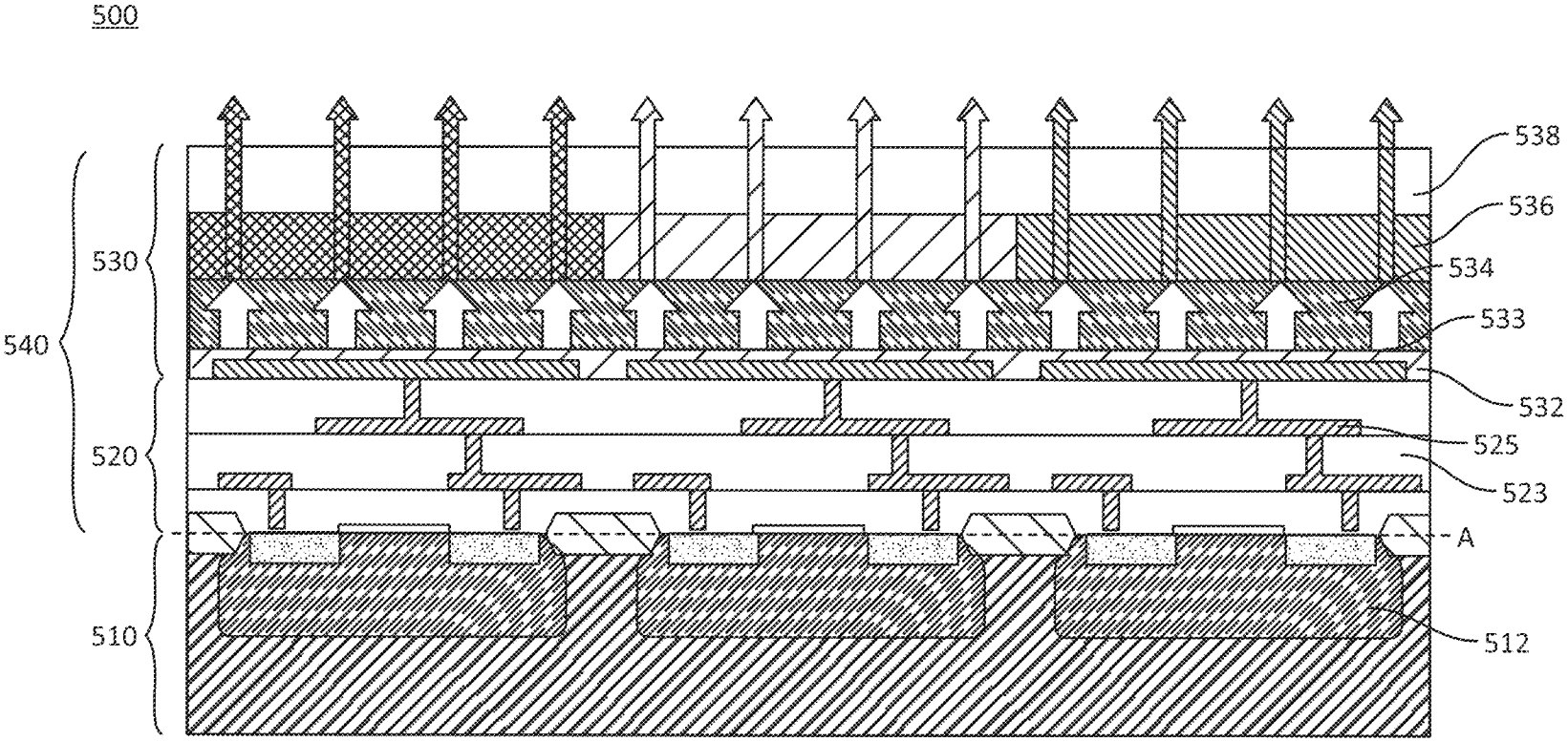
FIG. 5 is a schematic view of an OLED display device architecture including a display driver integrated circuit (DDIC), according to some embodiments.

FIG. 5 is a schematic view of an OLED display device architecture including a display driver integrated circuit (DDIC) 510 according to some embodiments. According to some embodiments, OLED display device 500 (e.g., micro-OLED chip) may include a display active area 530 having an active matrix 532 (such as OLED 400) disposed over a single crystal (e.g., silicon) backplane 520. The combined display/backplane architecture, i.e., display panel 540 may be bonded (e.g., at or about interface A) directly or indirectly to the DDIC 510. As illustrated in FIG. 5, DDIC 510 may include an array of driving transistors 512, which may be formed using conventional CMOS processing. One or more display driver integrated circuits may be formed over a single crystal (e.g., silicon) substrate.

In some embodiments, the display active area 530 may have at least one areal dimension (i.e., length or width) greater than approximately 1.3 inches, e.g., approximately 1.4, 1.5, 1.6, 1.7, 1.8, 1.9, 2.0, 2.25, 2.5, 2.75, or 3 inches, including ranges between any of the foregoing values, although larger area displays are contemplated.

Backplane 520 may include a single crystal or polycrystalline silicon layer 523 having a through silicon via 525 for electrically connecting the DDIC 510 with the display active area 530. In some embodiments, display active area 530 may further include a transparent encapsulation layer 534 disposed over an upper emissive surface 533 of active matrix 532, a color filter 536, and cover glass 538.

According to various embodiments, the display active area 530 and underlying backplane 520 may be manufactured separately from, and then later bonded to, DDIC 510, which may simplify formation of the OLED active area, including formation of the active matrix 532, color filter 536, etc.

The DDIC 510 may be directly bonded to a back face of the backplane opposite to active matrix 532. In further embodiments, a chip-on-flex (COF) packaging technology may be used to integrate display panel 540 with DDIC 510, optionally via a data selector (i.e., multiplexer) array (not shown) to form OLED display device 500. As used herein, the terms "multiplexer" or "data selector" may, in some examples, refer to a device adapted to combine or select from among plural analog or digital input signals, which are transmitted to a single output. Multiplexers may be used to increase the amount of data that can be communicated within a certain amount of space, time, and bandwidth.

As used herein, "chip-on-flex" (COF) may, in some examples, refer to an assembly technology where a microchip or die, such as an OLED chip, is directly mounted on and electrically connected to a flexible circuit, such as a direct driver circuit. In a COF assembly, the microchip may avoid some of the traditional assembly steps used for individual IC packaging. This may simplify the overall processes of design and manufacture while improving performance and yield.

In accordance with certain embodiments, assembly of the COF may include attaching a die to a flexible substrate, electrically connecting the chip to the flex circuit, and encapsulating the chip and wires, e.g., using an epoxy resin to provide environmental protection. In some embodiments, the adhesive (not shown) used to bond the chip to the flex substrate may be thermally conductive or thermally insulating. In some embodiments, ultrasonic or thermosonic wire bonding techniques may be used to electrically connect the chip to the flex substrate.

Figure 6:
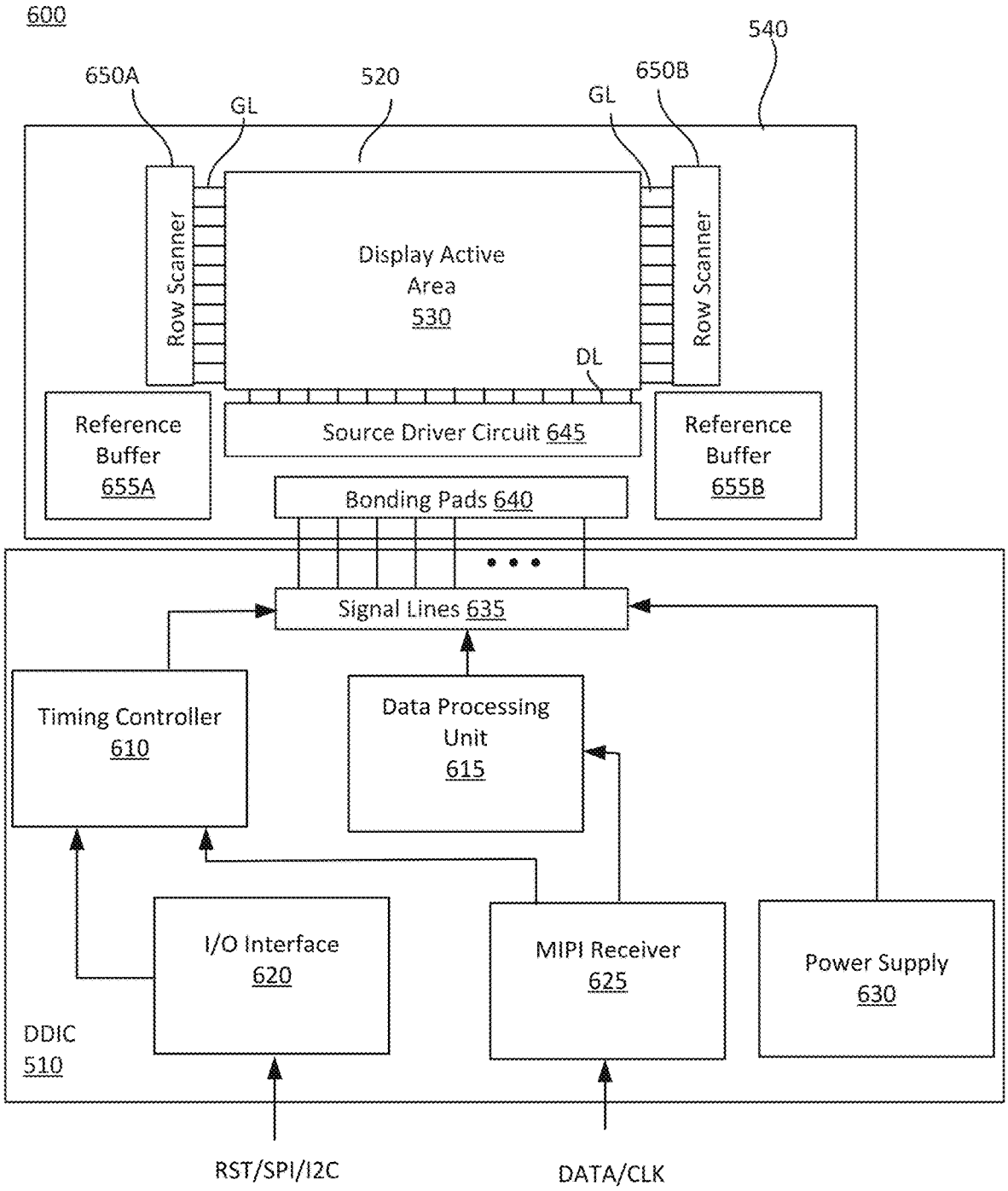
FIG. 6 is a schematic view of an OLED display device, according to some embodiments.

FIG. 6 is a schematic view of an OLED display device 600 according to some embodiments. The OLED display device 600 may include, among other components, the DDIC 510 and the display panel 540. The display panel 540 may be an integrated circuit including the backplane 520, the display active area 530, bonding pads 640, and a control circuit for controlling the display active area 530. The control circuit may include a source driver circuit 645, one or more row scanners 650, and one or more reference buffers 655. The DDIC 510 may include a timing controller 610, a data processing circuit 615, an input/output (I/O) interface 620, a mobile industry processor interface (MIPI) receiver 625, a power supply 630, and signal lines 635. In other embodiments, one or more components of the DDIC 510 may be disposed in the display panel 540.

The timing controller 610 may be configured to generate timing control signals for the row scanner 650, the source driver circuit 645, the address decoder 660, and other components in the display panel 540. The timing control signals may include a clock, a vertical synchronization signal, a horizontal synchronization signal, and a start pulse. However, timing control signals provided from the timing controller 610 according to embodiments of the present disclosure are not limited thereto.

The data processing unit 615 may be configured to receive image data DATA from the MIPI receiver 630 and convert the data format of the image data DATA to generate data voltages input to the source driver circuit 645 that provides data voltages to the display active area 530 for displaying images.

The I/O interface 620 is a circuit that receives control signals from other sources and sends operation signals to the timing controller 610. The control signals may include a reset signal RST to reset the display panel 540 and signals according to serial peripheral interface (SPI) or inter-integrated circuit (I2C) protocols for digital data transfer. Based on the received control signals, the I/O interface 620 may process commands from a system on a chip (SoC), a central processing unit (CPU), or other system control chip.

The MIPI receiver 625 may be a MIPI display serial interface (DSI), which may include a high-speed packet-based interface for delivering video data to the pixels in the display active area 530. The MIPI receiver 625 may receive image data DATA and clock signals CLK and provide timing control signals to the timing controller 610 and image data DATA to the data processing unit 615.

The power supply 630 provides power to the row scanner 650, the source driver circuit 645, and the reference buffer 655 used to control the display active area 530. The power supply 630 includes multiple power rails to provide constant voltages such as a first power supply voltage ELVDD, a second power supply voltage ELVSS, a third power supply voltage AVSS, and a reference voltage Vref.

The display active area 530 includes a plurality of pixels with each pixel including a plurality of subpixels (e.g., a red subpixel, a green subpixel, a blue subpixel). Each subpixel is connected to a data line DL and driven to emit light according to a data voltage received through the connected data line DL. Each subpixel is also connected to a reference line, and the subpixel samples the reference voltage Vref used to determine threshold voltage variation of the driving transistor to maintain uniform image quality in the display active area 530.

The backplane 520 may include conductive traces for electrically connecting the pixels in the display active area 530, the row scanner 650, the source driver circuit 645, the bonding pads 640, and the reference buffer 655. The bonding pads 640 are conductive regions on the backplane 520 that are electrically coupled to the signal lines 635 of the DDIC 510 to receive timing control signals from the timing controller 610, data voltages from the data processing unit 615, and power supply voltages from the power supply 630. The signal lines 635 of the DDIC 510 and the bonding pads 640 of the display panel 540 may be connected through conductive lines.

The row scanner 650 may be connected to a plurality of gate lines GL and provide gate-on signals to the plurality of gate lines GL at appropriate times. In some embodiments, each subpixel in the display active area 530 is connected to one or more gate lines GL. The subpixel may include one or more switches that are implemented using transistors, and the one or more gate lines GL may be connected to gate terminals of the one or more switches. When a switch receives a gate-on signal at the gate terminal, the transistor function as a closed switch and allows current to follow, and when the switches receives a gate-off signal, the transistor functions as an open switch and does not allow current to flow. The row scanner 650 controls timing for operating the switches in the subpixels for sampling the reference voltage Vref and the data voltages Vdata and causing the OLED to emit light.

The source driver circuit 645 may receive data voltages from the data processing unit 615 and provide the data voltages to the display active area 530 via data lines DL. The source driver circuit 645 is connected to a plurality of data lines DL each connected to a column of subpixels.

The reference buffer 655 is an operational amplifier (OPAMP) based analog buffer that provides the reference voltage Vref to subpixels in the display active area 530. The reference buffer 655 is connected to a bonding pad 640 that receives the reference voltage Vref from the power supply 630 in the DDIC 510 through a signal line 635. The reference buffer 655 may include one or more OPAMPs. The reference buffer 655 is discussed in detail in FIGS. 10A-10C.

Figure 7A:
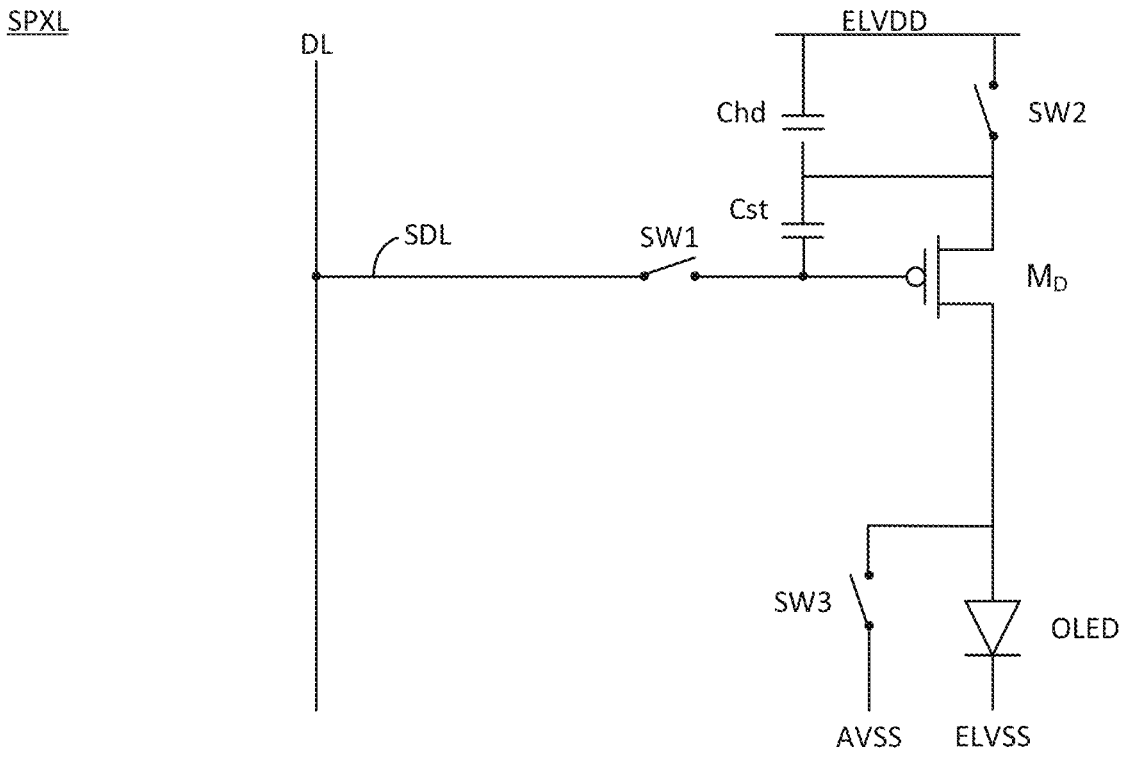
FIG. 7A illustrate a subpixel structure, according to some embodiments.

FIG. 7A illustrate a subpixel SPXL structure according to some embodiments. The subpixel SPXL includes a driving transistor MD including a gate terminal, a first terminal, and a second terminal. The gate terminal of the driving transistor MD is connected to a data line DL through a first switch SW1. The data line DL is connected to a column of subpixels SPXL, and for each subpixel SPXL, the first switch SW1 of the subpixel SPXL in the column is connected to the data line DL through a subpixel data line PDL. The data line DL provides data voltages Vdata and reference voltage Vref from the source driver circuit 645 to the subpixel SPXL at different times. A first capacitor Cst is connected between the gate terminal and the first terminal of the driving transistor MD. A second capacitor Chd is connected between the first power supply voltage ELVDD and the first terminal of the driving transistor MD. A second switch SW2 is also connected between the first power supply voltage ELVDD and the first terminal of the driving transistor MD.

The driving transistor MD generates a current according to a voltage stored by the first capacitor Cst for driving the OLED. The current increases when the stored voltage in the first capacitor Cst (e.g., Vgs of the driving transistor MD) increases and decreases when the stored voltage decreases. The anode of the OLED is connected to the second terminal of the driving transistor MD, and the cathode of the OLED is connected to a second power supply voltage ELVSS. A third switch SW3 is connected between the anode of the OLED and a third power supply voltage AVSS. When the third switch SW3 is closed, the anode of the OLED is connected to the third power supply voltage AVSS which prevents the OLED from emitting light. The third switch SW3 is used to prevent the OLED from emitting light while the subpixel SPXL is sampling the data voltages Vdata and the reference voltage Vref.

Figure 7B:
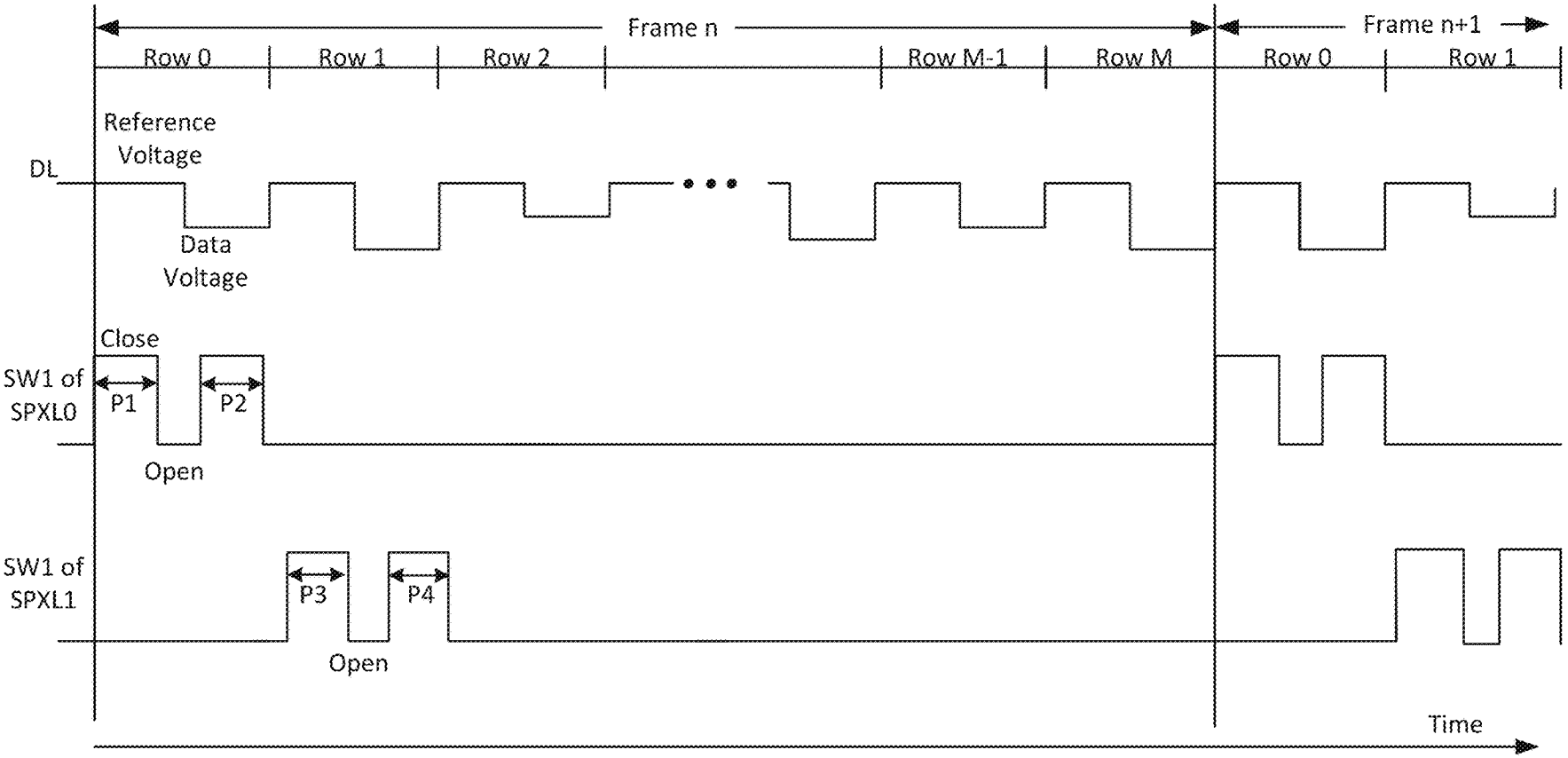
FIG. 7B illustrates a timing diagram for operating the subpixel structure of FIG. 7A, according to some embodiments.

FIG. 7B illustrates a timing diagram for operating the subpixel structure of FIG. 7A, according to some embodiments. The data line DL is connected to the source driver circuit 645 that provides data voltages to a column of subpixels SPXL. During a frame, the voltage of the data line DL alternates between a reference voltage Vref and a data voltage Vdata for each row in the display active area 530. That is, during a subframe corresponding to a row (e.g., row 0, row 1, . . . row m−1, row m), the voltage at the data line DL is at the reference voltage Vref during a first portion and at the data voltage Vdata during a second portion. The reference voltage Vref is a constant voltage sampled and used by the subpixel SPXL to compensate for variation in a threshold voltage of the driving transistor MD. The data voltage Vdata is a variable voltage that controls the brightness of the OLED in the subpixel. In FIG. 7B, the timing for a first switch SW1 of a subpixel in row 0 of the display active area 530 (referred to herein as "subpixel SPXL0") and a first switch SW1 of a subpixel in row 1 of the display active area 530 (referred to herein as "subpixel SPXL1") is shown.

During a first period P1, the first switch SW1 of subpixel SPXL0 is closed and connects the data line DL to the gate terminal of the driving transistor MD to sample the reference voltage Vref at the data line DL. The second switch SW2 is also closed. When the reference voltage Vref is applied to the gate terminal of the driving transistor MD, the threshold voltage of the driving transistor MD is sensed and provided to the DDIC 510 such that the data voltage to be provided via the data line DL may be adjusted to compensate for any deviation in the threshold voltage of the driving transistor MD. When the OLED display device 600 is used beyond a threshold time, characteristics including threshold voltage of the driving transistor MD may drift over time. Sensing the threshold voltage and compensating for the deviation by adjusting the data voltage Vdata at the data line DL allows the display device 600 to display images with consistent image quality. Light emitted by the OLED depends on a difference in voltage between the reference voltage Vref and the data voltage Vdata. Since the reference voltage Vref is a constant voltage value, the data voltage Vdata is modified when there is a change in the threshold voltage. During the first period P1, when the first switch SW1 is closed for sampling the reference voltage Vref in the data line DL, the sampled reference voltage Vref is stored across the first capacitor Cst. Based on the sampled reference voltage Vref, the threshold voltage of the driving transistor MD is determined and provided to the DDIC 510 to modify the data voltage Vdata as necessary. After the threshold voltage has been determined but before the end of the first period P1, the second switch SW2 is opened to allow the first capacitor Cst to self-discharge. During the first period P1, the third switch SW3 is closed to prevent the OLED from emitting light.

At the end of the first period P1, the first switch SW1 is opened to disconnect the data line DL from the gate terminal of the driving transistor MD while the voltage of the data line DL changes from the reference voltage Vref to the data voltage Vdata. During a second period P2, the first switch SW1 is closed to sample the data voltage Vdata at the data line DL, the second switch SW2 remains open, and the third switch SW3 remains closed. The first capacitor Cst and the second capacitor Chd are charged according to the sampled data voltage Vdata that is used to drive the OLED during an emission period subsequent to the second period P2. During the emission period, the first switch SW1 and the third switch SW3 are opened, and the second switch SW2 is closed to cause the OLED to emit light.

After the second period P2, the data line DL provides the reference voltage Vref and the data voltage Vdata sequentially to a subpixel SPXL1 in row 1 of the display active area 530 adjacent to row 0. During a third period P3, the first switch SW1 of the subpixel SPXL1 connects the data line DL to a gate terminal of the subpixel SPXL1 to sample the refence voltage Vref. During a fourth period P4, the first switch SW1 of the subpixel SPXL1 connects the data line DL to the gate terminal of the subpixel SPXL1 to sample the data voltage Vdata for operating the OLED of the subpixel SPXL1. The third period P3 and the fourth period P4 may overlap with a portion of the emission period of the subpixel SPXL0 in row 0. When both the reference voltage Vref and the data voltage Vdata are provided over the same data line DL, the subpixel SPXL1 in row 1 cannot begin sampling until the data line DL completes providing the reference voltage Vref and the data voltage Vdata to the subpixel SPXL0 in row 0. Therefore, it is difficult to reduce frame rate of the display device 600.

Figure 8A:
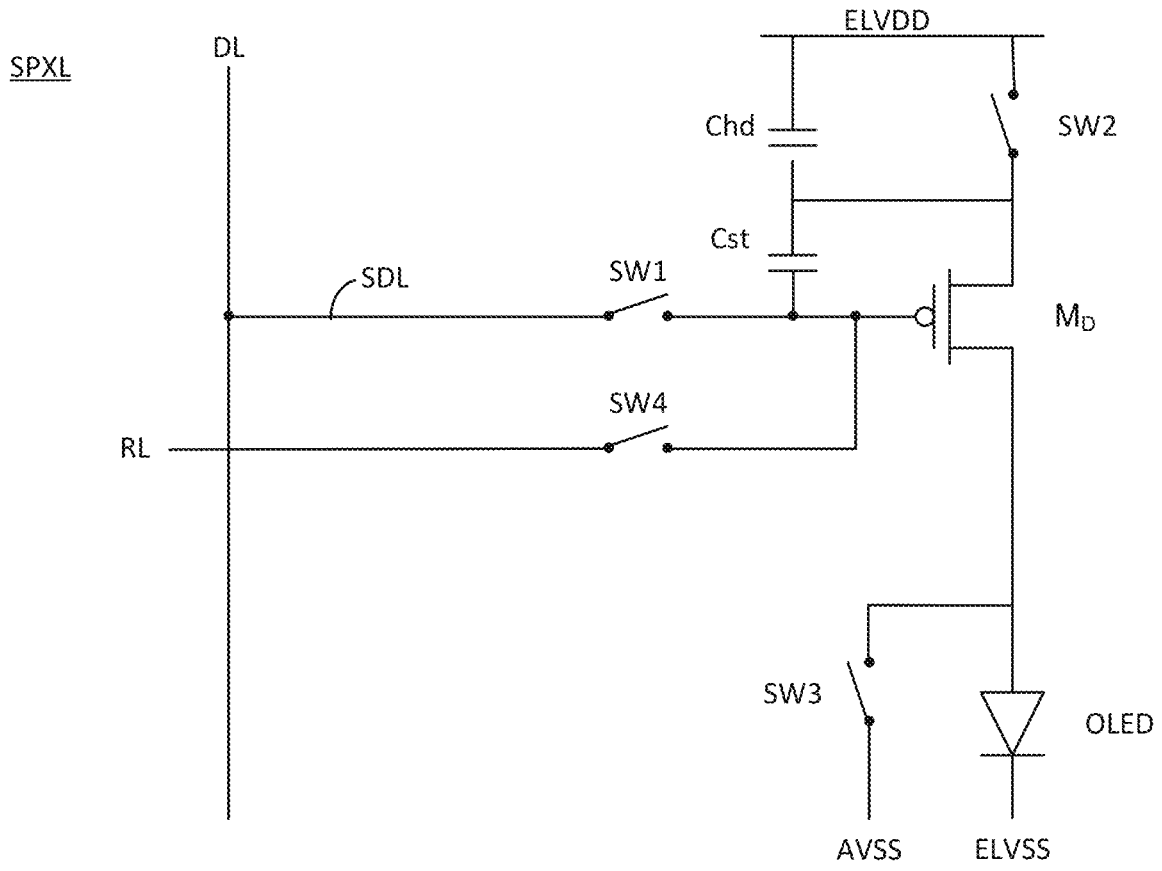
FIG. 8A illustrate a subpixel structure connected to a reference line, according to some embodiments.

FIG. 8A illustrate a subpixel structure connected to a reference line, according to some embodiments. In addition to the components from the subpixel SPXL of FIG. 7A, the subpixel SPXL of FIG. 8A further includes a fourth switch SW4 connected between a reference line RL and the gate terminal of the driving transistor MD. The reference line RL is connected to the reference buffer 655 that provides a constant reference voltage Vref used for compensation. Unlike subpixel SPXL of FIG. 7A that provides both the reference voltage Vref and the data voltage Vdata via the data line DL, in the subpixel SPXL of FIG. 8A, the data voltage Vdata is provided via the data line DL and the reference voltage Vref is separately provided via the reference line RL.

Figure 8B:
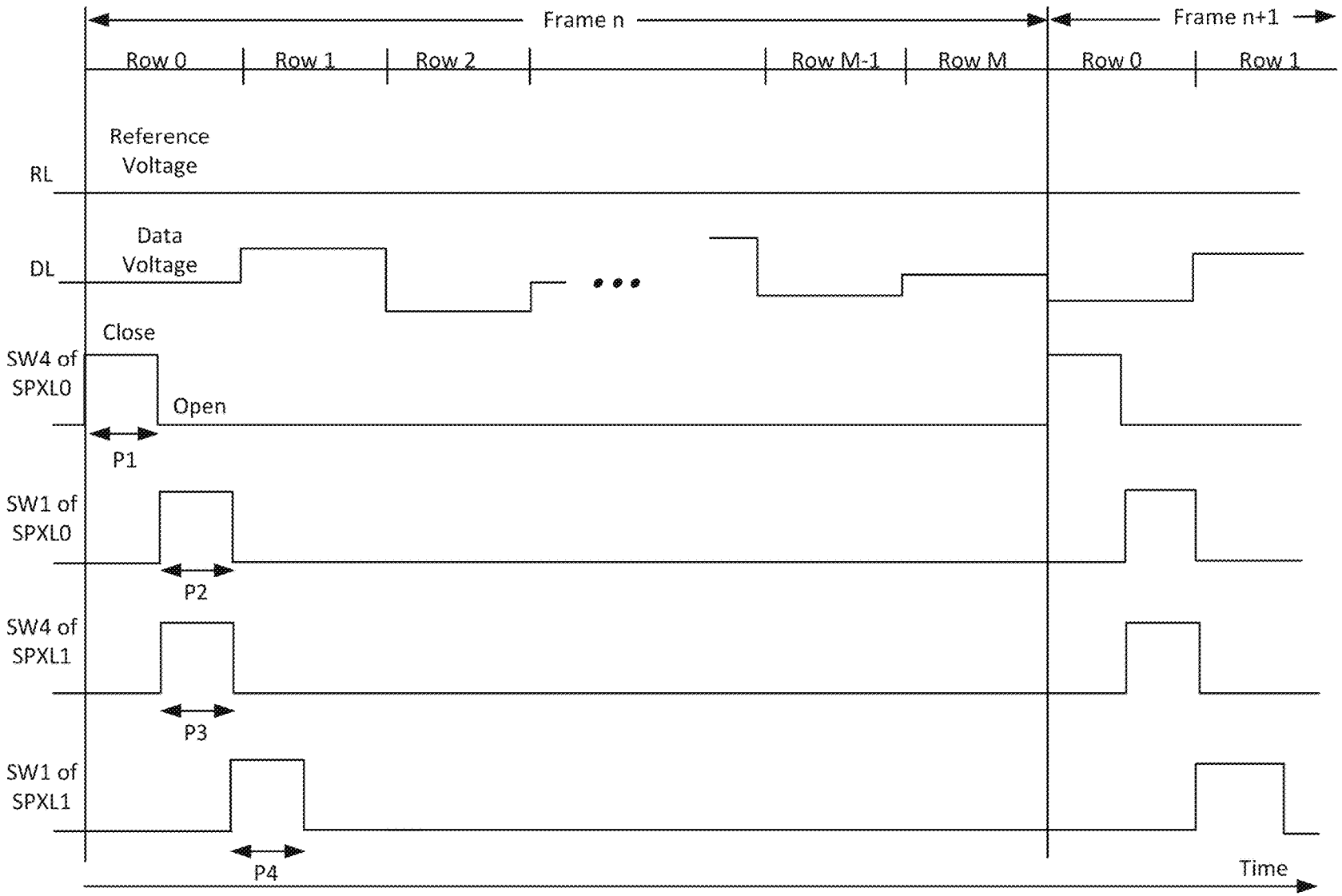
FIG. 8B illustrates a timing diagram for operating the subpixel structure of FIG. 8A, according to some embodiments.

FIG. 8B illustrates a timing diagram for operating the subpixel structure of FIG. 8A, according to some embodiments. In FIG. 8B, the timing for a first switch SW1 and a fourth switch SW4 of a subpixel in row 0 of the display active area 530 (referred to herein as "subpixel SPXL0") and a first switch SW1 and a fourth switch SW4 of a subpixel in row 1 of the display active area 530 (referred to herein as "subpixel SPXL1") is shown.

The reference line RL outputs a constant reference voltage Vref. During a first period P1, the fourth switch SW4 of the subpixel SPXL0 is closed to sample the reference voltage Vref at the reference line RL, and during a second period P2, the first switch SW1 is closed and the fourth switch SW4 is opened to sample the data voltage Vdata at the data line DL. During a third period P3, the fourth switch SW4 of the subpixel SPXL1 is closed to sample the reference voltage Vref at the reference line RL, and a fourth period P4, the fourth switch SW4 of the subpixel SPXL1 is closed to sample the data voltage Vdata at the data line DL. The third period P3 overlaps with at least a portion of the second period P2. As discussed above with respect to FIG. 7B, when subpixels SPXL have the structure illustrated in FIG. 7A, the first switch SW1 is used to sample the reference voltage Vref and the data voltage Vdata that are provided through the same data line DL. In contrast, with the subpixel structure illustrated in FIG. 8A, the reference voltage Vref is provided to the gate terminal of the driving transistor MD via a reference line RL separate from the data line DL. The data line DL is used to provide data voltages Vdata to the column of subpixels SPXL that are connected to the data line DL. That is, during a subframe corresponding to a row (e.g., row 0, row 1, . . . row m−1, row m), only the data voltage Vdata for the row is provided at the data line.

Figure 9A:
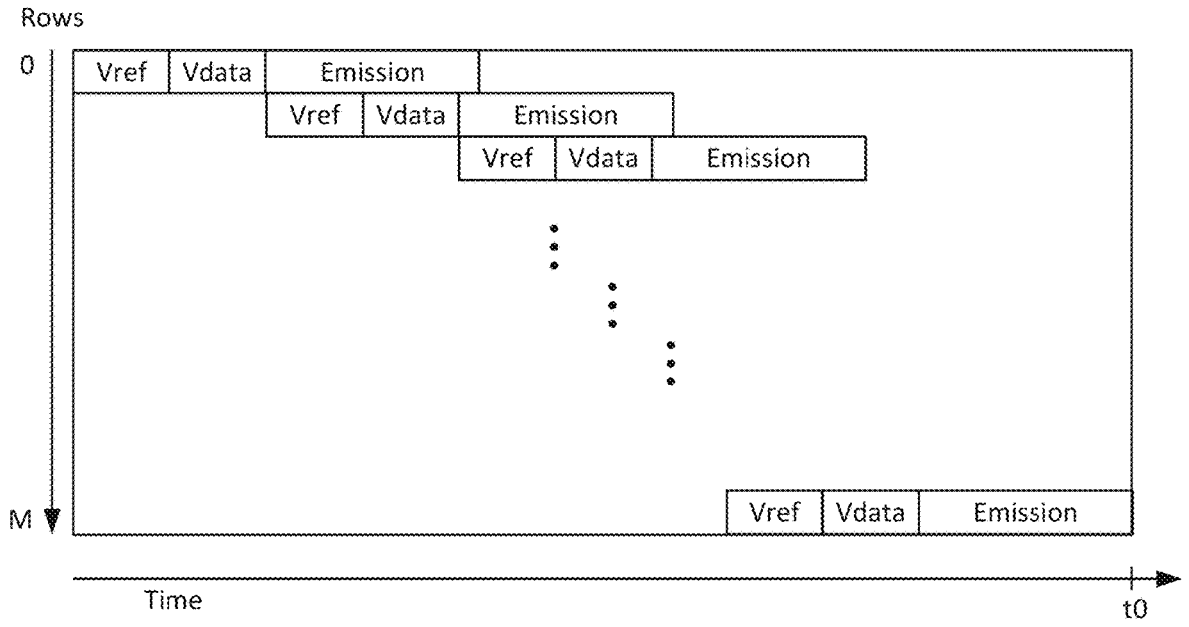
FIG. 9A is a timing diagram illustrating operation of an OLED display device including pixels having the subpixel structure of FIG. 7A, according to some embodiments.
Figure 9B:
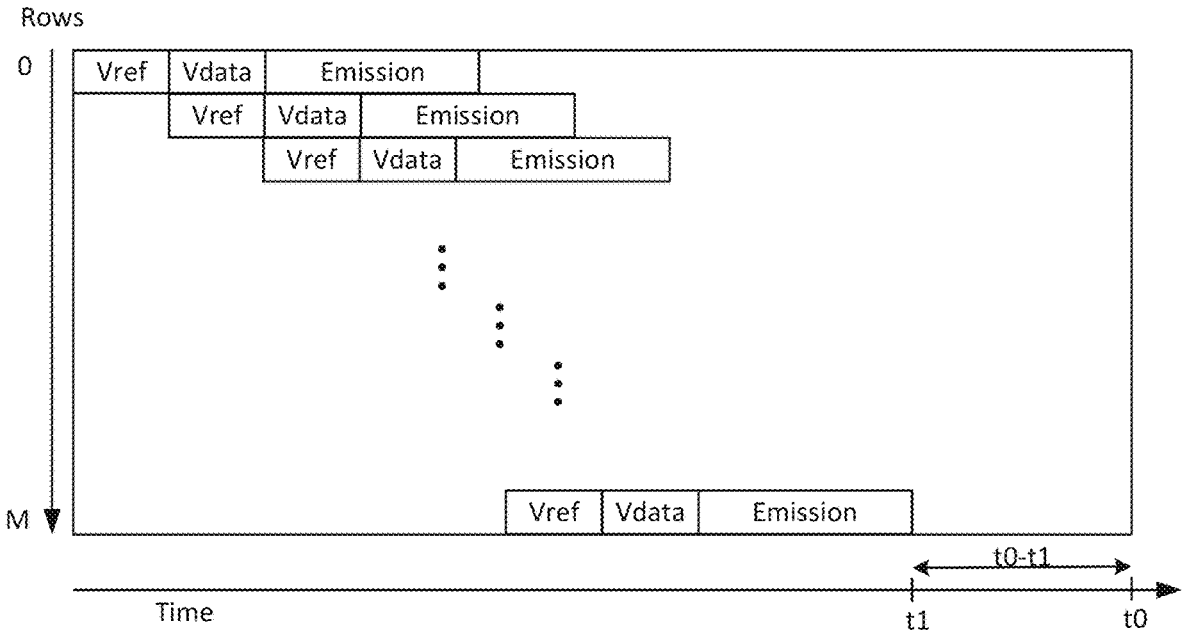
FIG. 9B is a timing diagram illustrating operation of an OLED display device including pixels having the subpixel structure of FIG. 8A, according to some embodiments.

FIG. 9A is a timing diagram illustrating operation of an OLED display device including pixels having the subpixel structure of FIG. 7A, and FIG. 9B is a timing diagram illustrating operation of an OLED display device including pixels having the subpixel structure of FIG. 8A, according to some embodiments. In FIG. 9A, a period during which the data voltage is sampled for a first row of pixels cannot overlap with a period during which the reference voltage is sampled for a second row of pixels adjacent to the first row because the data voltage Vdata and the reference voltage Vref are provided by the same data line DL. A display frame for a display device 600 having the subpixel structure of FIG. 7A may last a first duration t0.

In FIG. 9B, a period during which the data voltage Vdata is sampled for the first row overlaps with at least a portion of the period during which the reference voltage Vref is sampled for the second row of pixels. Because there is an overlap during the period during which the reference voltage Vref is provided for one row and a period during which the data voltage Vdata is provided for a next row, a frame rate of the display device 600 can be improved by reducing the scan time. A display frame for a display device 600 having the subpixel structure of FIG. 8A lasts for a second duration t1 that is shorter than the first duration t0. That is, a display device having the subpixel structure of FIG. 8A can complete scanning a display frame in a duration that is (t0-t1) less than a display device having the subpixel structure of FIG. 7A. Thus, the pixel structure of FIG. 8A can support a higher frame rate compared to the pixel structure of FIG. 7A without making the period for sampling the reference voltage Vref or data voltage Vdata shorter and sacrificing image quality due to settling errors.

Figure 10A:
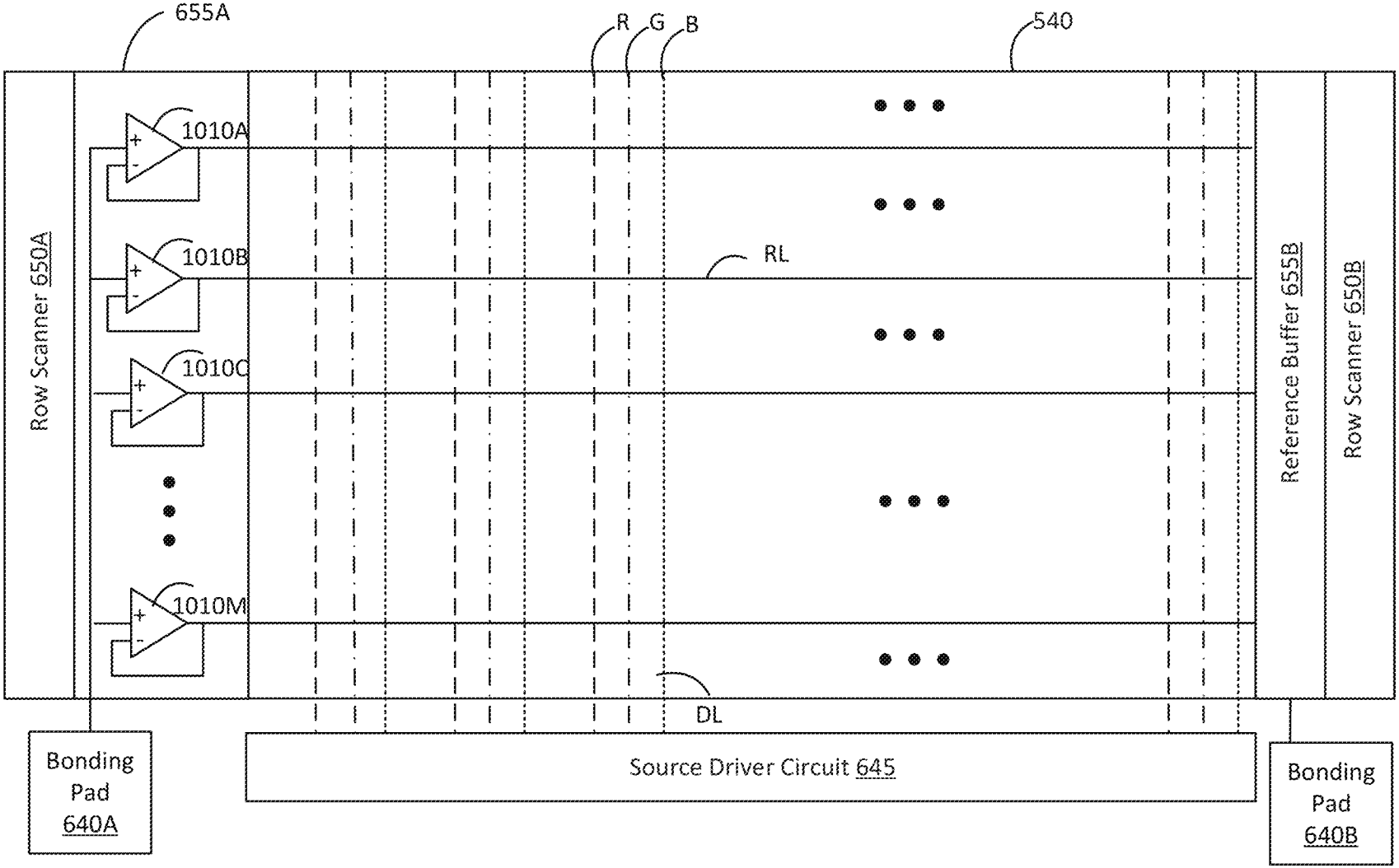
FIG. 10A is a schematic view of a display panel including a first type of reference buffer, according to some embodiments.

FIG. 10A is a schematic view of a display panel including a first type of reference buffer, according to some embodiments. In FIG. 10A, a first reference buffer 655A is disposed in a non-display area on a first side of the display panel 540 (e.g., to the left of the display active area 530), and a second reference buffer 655B is disposed in the non-display area on a second side of the display panel opposite to the first side (e.g., to the right of the display active area 530). The reference buffers 655 are operational amplifier (OPAMP) based analog buffers. Each of the first reference buffer 655A and the second reference buffer 655B includes a plurality of OPAMPs 1010 such that there is an OPAMP 1010 for each row of pixels. The inverting inputs of the plurality of OPAMPs 1010 in a reference buffer 655 are connected to a common bonding pad 640 that receives the reference voltage Vref from the power supply 630 of the DDIC 510. The plurality of OPAMPs 1010 are unity-gain buffers that each outputs the reference voltage Vref to a row of pixels via a reference line RL. Because there is a separate OPAMP 1010 for each row, one or more OPAMPs 1010 that are not being used may be turned off while one or more other OPAMPs 1010 are on. This allows the display device 600 to save power consumption.

A first row scanner 650A is disposed in a non-display area of the display panel 540 at the first side of the display panel and the second row scanner 650B is disposed in the non-display area of the display panel 540 at the second side of the display panel. The row scanners 650 are configured to provide control signals to open and close the first switch SW1, the second switch SW2, the third switch SW3, and the fourth switch SW4 to operate the subpixels SPXL. Although not illustrated, the row scanners 650 are connected to gate lines GL that extend in a same direction as the reference lines RL. The source driver circuit 645 is disposed in the non-display area of the display panel 540 at a third side of the display panel (e.g., along the bottom of the display active area 530) that is adjacent to the first and second sides. The source driver circuit 645 provides data voltages Vdata to the subpixels SPXL in the display active area 530 via data lines DL. Each column of red subpixels R, green subpixels G, and blue subpixels B is connected to a different data line DL of the source driver circuit 645.

Figure 10B:
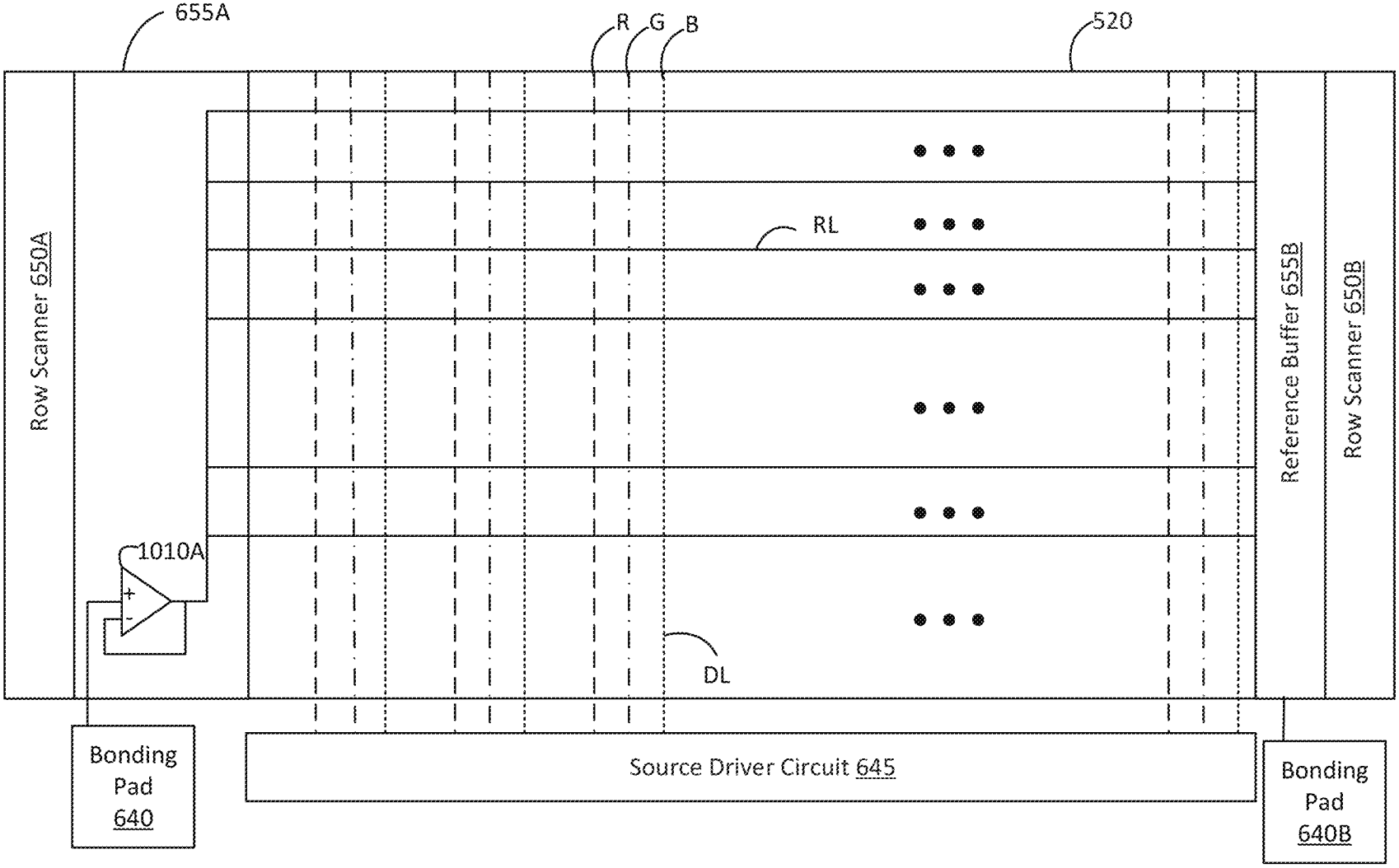
FIG. 10B is a schematic view of a display panel including a second type of reference buffer, according to some embodiments.

FIG. 10B is a schematic view of a display panel including a second type of reference buffer, according to some embodiments. In FIG. 10B, the first reference buffer 655A includes a global OPAMP 1010A that outputs the reference voltage Vref to all the reference lines RL connected to the first reference buffer 655A. Similarly, the second reference buffer 655B includes a global OPAMP 1010B. When the reference buffer 655 has one global OPAMP 1010, the size of the reference buffer 655 can be made smaller and the size of the display device 600 can be reduced.

Figure 10C:
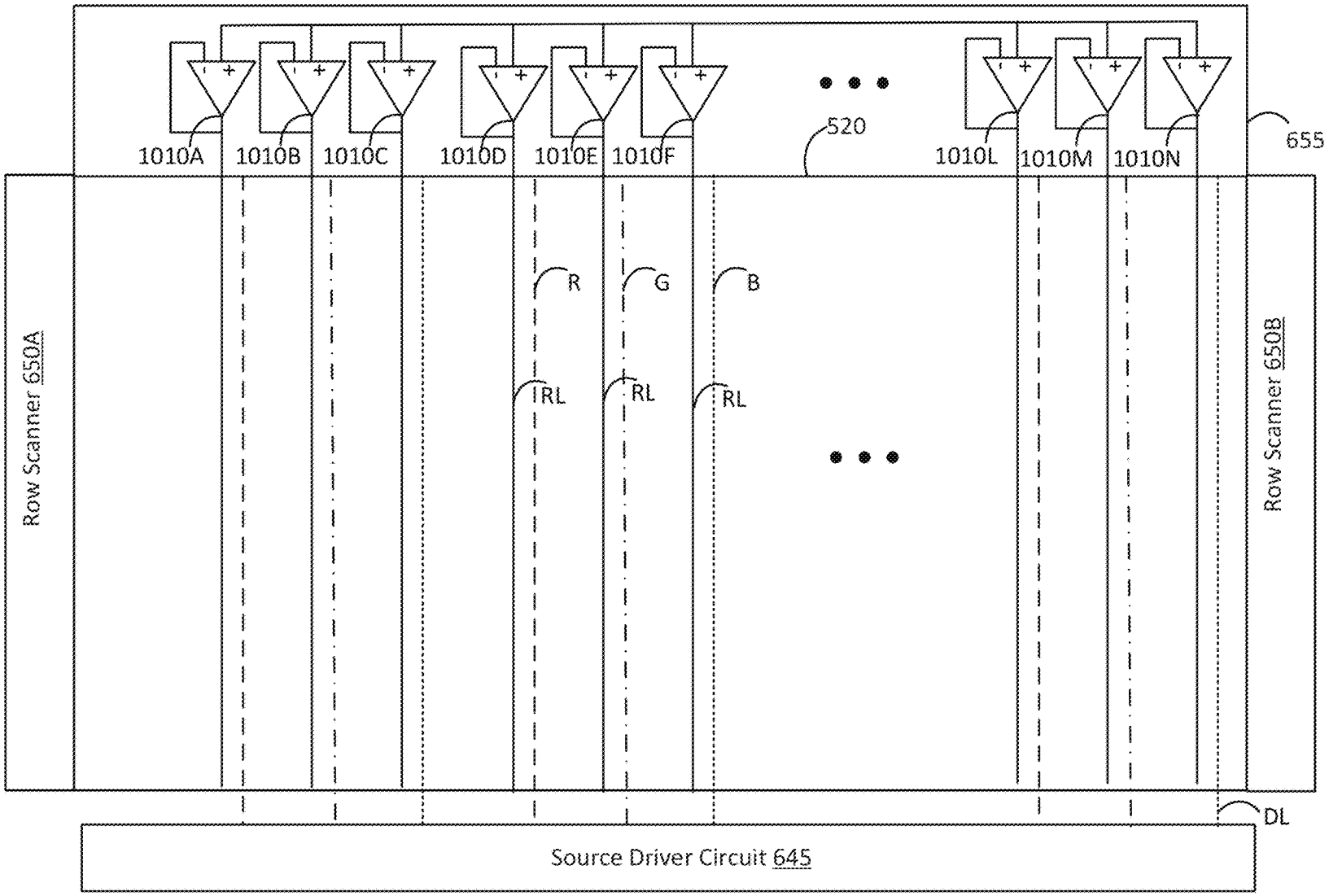
FIG. 10C is a schematic view of a display panel including a third type of reference buffer, according to some embodiments.

FIG. 10C is a schematic view of a display panel including a third type of reference buffer, according to some embodiments. The reference buffer 655 that includes a plurality of OPAMPs 1010 is disposed in the non-display area of the display panel 540 at a side opposite to the source driver circuit 645. Each column of pixels is connected to a reference line that extends in a direction parallel to the data lines DL. When the reference buffer 655 is disposed on the opposite side of the source driver circuit 645 instead of the same side as the row scanner 650, the column layout of the display panel 540 can be simpler and have reduced noise coupling issues. FIGS. 10A, 10B, and 10C are merely examples of the display panel layout, and components of the display panel may be arranged differently from the illustrated examples.

Figure 11:
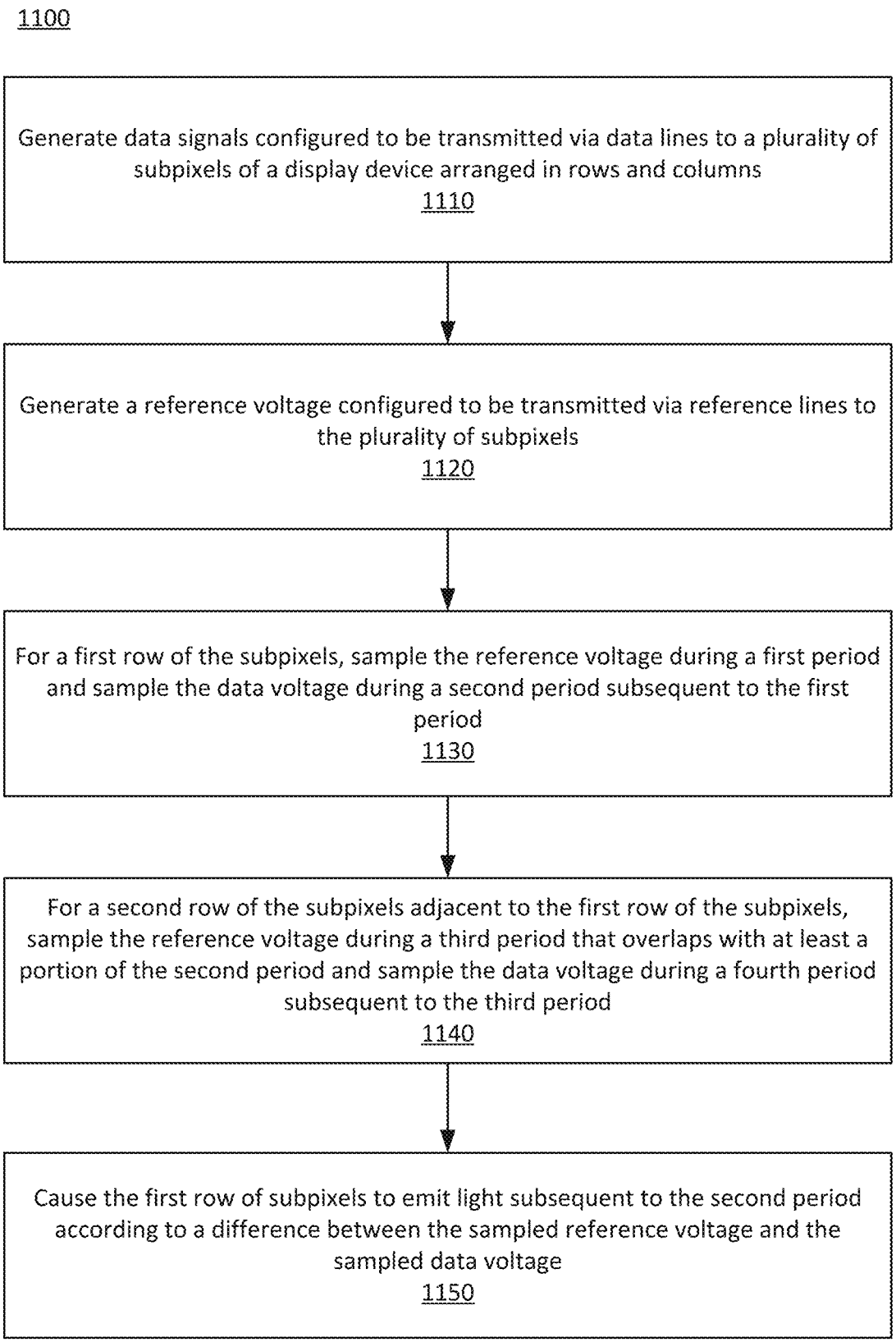
FIG. 11 is a flowchart illustrating an operation of an OLED display device according to some embodiments.

FIG. 11 is a flowchart illustrating an operation of an OLED display device according to some embodiments. An OLED display device generates 1110 data voltages configured to be transmitted via data lines to a plurality of subpixels of a display device arranged in rows and columns. The OLED display device generates 1120 a reference voltage configured to be transmitted via reference lines to the plurality of subpixels. For a first row of the subpixels, the OLED display device samples 1130 the reference voltage during a first period and samples the data voltage during a second period subsequent to the first period. For a second row of the subpixels adjacent to the first row of the subpixels, the OLED display device samples 1140 the reference voltage during a third period that overlaps with at least a portion of the second period and samples the data voltage during a fourth period subsequent to the third period. The OLED display device causes 1150 the first row of subpixels to emit light subsequent to the second period according to a difference between the sampled reference voltage and the sampled data voltage.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A display device, comprising:

a display driver circuit configured to generate data voltages and a reference voltage; and a display panel coupled to the display driver circuit, the display panel comprising:

a plurality of data lines;

a plurality of reference lines;

subpixels arranged in rows and columns, each subpixel configured to emit light according to a difference between a sampled data voltage from a data line of the plurality of data lines and a sampled reference voltage from a reference line of the plurality of reference lines;

a source driver circuit configured to provide the data voltages to the subpixels via the plurality of data lines extending in a first direction, each data line connected to a column of subpixels; and a reference buffer configured to provide the reference voltage to the subpixels via the plurality of reference lines, wherein a first row of the subpixels is configured to sample the reference voltage during a first period and sample the data voltages during a second period subsequent to the first period, and wherein a second row of the subpixels adjacent to the first row of subpixels is configured to sample the reference voltage during a third period that overlaps with at least a portion of the second period.

2. The display device of claim 1, wherein the reference buffer includes one or more operational amplifiers configured to output the reference voltage to one or more reference lines.

3. The display device of claim 2, wherein a first operational amplifier of the one or more operational amplifiers is turned off while a second operational amplifier of the one or more operational amplifiers is turned on.

4. The display device of claim 1, wherein the source driver circuit is disposed in a first non-display area at a first side of the display panel, and the reference buffer is disposed in a second non-display area at a second side of the display panel opposite to the first side, the plurality of reference lines extending in the first direction parallel to the data lines.

5. The display device of claim 1, wherein the source driver circuit is disposed in a first non-display area at a first side of the display panel, and the reference buffer is disposed in a second non-display area at a second side of the display panel adjacent to the first side, the plurality of reference lines extending in a second direction different from the first direction of the data lines.

6. The display device of claim 1, wherein each subpixel data voltage comprises:

a driving transistor including a gate terminal, a first terminal, and a second terminal;

a first switch configured to connect or disconnect the data line and the gate terminal of the driving transistor to sample the data voltages from the data line;

a second switch configured to connect or disconnect the reference line and the gate terminal of the driving transistor to sample the reference voltage from the reference line; and a light emitting device connected between the second terminal of the driving transistor and a second power supply voltage, the light emitting device configured to emit light according to the difference between the sampled data voltages and the sampled reference voltage.

7. The display device of claim 6, wherein the subpixel further comprises:

a first capacitor connected between the gate terminal and the first terminal of the driving transistor;

a second capacitor connected between the first terminal of the driving transistor and a first power supply voltage;

a third switch configured to connect or disconnect the first terminal of the driving transistor and the first power supply voltage; and a fourth switch configured to connect or disconnect the second terminal of the driving transistor and a third power supply voltage.

8. The display device of claim 6, wherein the display driver circuit is configured to adjust the data voltages provided to the data line based on a threshold voltage associated with the driving transistor.

9. A method comprising:

generating data voltages configured to be transmitted via data lines to a plurality of subpixels of a display device arranged in rows and columns;

generating a reference voltage configured to be transmitted via reference lines to the plurality of subpixels;

for a first row of the subpixels, sampling the reference voltage during a first period and sampling the data voltages during a second period subsequent to the first period;

for a second row of the subpixels adjacent to the first row of the subpixels, sampling the reference voltage during a third period that overlaps with at least a portion of the second period and sampling the data voltages during a fourth period subsequent to the third period; and causing the first row of subpixels to emit light subsequent to the second period according to a difference between the sampled reference voltage and the sampled data voltage.

10. The method of claim 9, wherein the first row of subpixels emits light during at least a portion of the third period or the fourth period.

11. The method of claim 9, wherein the reference voltage is transmitted to a reference buffer including one or more operational amplifiers configured to provide the reference voltage to the plurality of subpixels via the plurality of reference lines.

12. The method of claim 9, wherein the data voltages are transmitted to a source driver circuit configured to provide the data voltages to a subpixel in the first row of subpixels via a data line, and the reference voltage is transmitted to a reference buffer configured to provide the reference voltage to the subpixel via a reference line, the subpixel comprising:

a driving transistor including a gate terminal, a first terminal, and a second terminal;

a first switch configured to connect or disconnect the data line and the gate terminal of the driving transistor to sample the data voltages from the data line;

a second switch configured to connect or disconnect the reference line and the gate terminal of the driving transistor to sample the reference voltage from the reference line;

a light emitting device connected between the second terminal of the driving transistor and a second power supply voltage, the light emitting device configured to emit light according to the difference between the sampled data voltages and the sampled reference voltage.

13. The method of claim 12, further comprising:

causing the second switch to connect the reference line and the gate terminal of the driving transistor during the first period; and causing the first switch to connect the data line and the gate terminal of the driving transistor during the second period.

14. The method of claim 13, wherein causing the subpixel to emit light further comprises:

causing a third switch to connect the first terminal of the driving transistor and a first power supply voltage during an emission period subsequent to the second period to cause the subpixel to emit light.

15. The method of claim 13, further comprising:

causing a fourth switch to connect to the second terminal of the driving transistor and a third power supply voltage during the first period and the second period.

16. An electronic device comprising:

a display driver circuit configured to generate data voltages and a reference voltage; and a display panel coupled to the display driver circuit, the display panel comprising:

a plurality of data lines;

a plurality of reference lines;

subpixels arranged in rows and columns, each subpixel configured to emit light according to a difference between sampled data voltages from a data line of the plurality of data lines and sampled reference voltage from a reference line of the plurality of reference lines;

a source driver circuit configured to provide the data voltages to the subpixels via the plurality of data lines extending in a first direction, each data line connected to a column of subpixels; and a reference buffer configured to provide the reference voltage to the subpixels via the plurality of reference lines, wherein a first row of the subpixels is configured to sample the reference voltage during a first period and sample the data voltages during a second time period subsequent to the first period, and wherein a second row of the subpixels adjacent to the first row of subpixels is configured to sample the reference voltage during a third period that overlaps with at least a portion of the second period.

17. The electronic device of claim 16, wherein the electronic device is a head-mounted display (HMD).

18. The electronic device of claim 16, wherein the reference buffer includes one or more operational amplifiers configured to output the reference voltage to one or more reference lines.

* * * * *